United States Patent [19]

Dolan

[11] 4,021,322

[45] May 3, 1977

[54] ELECTROLYTIC PREPARATION OF PHOSPHORUS ACID FROM ELEMENTAL PHOSPHORUS

[75] Inventor: Michael J. Dolan, Manchester, Mo.

[73] Assignee: Monsanto Company, St. Louis, Mo.

[22] Filed: Dec. 15, 1975

[21] Appl. No.: 640,506

[52] U.S. Cl. ..... 204/103

[51] Int. Cl.[2] ..... C25B 1/22

[58] Field of Search ..... 204/103

[56] References Cited

UNITED STATES PATENTS

| | | | |
|---|---|---|---|
| 3,437,438 | 4/1969 | Carroll | 23/165 |
| 3,437,439 | 4/1969 | Carroll | 23/165 |
| 3,437,440 | 4/1969 | Carroll | 23/165 |
| 3,528,772 | 9/1970 | Whyte et al. | 23/165 |
| 3,532,461 | 10/1970 | Whyte et al. | 23/165 |

OTHER PUBLICATIONS

Inorganic Syntheses, vol. IV, 1953, pp. 55–58, "Phosphorus Acid."

*Primary Examiner*—R. L. Andrews
*Attorney, Agent, or Firm*—Wendell W. Brooks; John D. Upham

[57] ABSTRACT

Elemental phosphorus is oxidized via indirect electrolytic oxidation to yield phosphorous acid, $(HO)_2HPO$.

12 Claims, 2 Drawing Figures

ELECTROLYTIC PREPARATION OF PHOSPHORUS ACID FROM ELEMENTAL PHOSPHORUS

BACKGROUND OF THE INVENTION

This invention relates to the indirect electrolytic oxidation of elemental phosphorus to phosphorous acid, $(HO)_2HPO$.

Phosphorous acid is available commercially as 30 percent and 70 percent aqueous solutions. The conventional method of preparation of phosphorous acid comprises hydrolyzing phosphorus trichloride according to the diagrammatically simplified reaction:

$$PCl_3 + 3H_2O \rightarrow (HO)_2HPO + 3HCl \quad (1)$$

and evaporating the excess water and the hydrogen chloride which are formed. However, the methods involving these raw materials suffer from a number of disadvantages, most of which are inherent in the prior art methods.

One of the more obvious and vexing difficulties associated with the known methods of preparation of phosphorous acid is the absence of simple, effective, and efficient means of disposal for the large volume of hydrogen halide produced during the conversion (either hydrolysis or otherwise) of phosphorus trihalide to the desired acid. Means which have been proposed for this purpose are generally expensive and less than satisfactory.

As a result of the difficulties and disadvantages associated with the known methods of preparation, phosphorus acid remains a relatively expensive chemical compound.

It has now been discovered that the difficulties and disadvantages of the prior art methods are overcome by the process of the present invention which represents a substantial improvement in the sense that:

a. the hydrogen halide generated is disposed of in situ in a manner which facilitates it being recycled for continued use with the result that only catalytic amount of hydrogen halide is required to be added initially; and b. phosphorous acid is obtained relatively inexpensively with a possible resulting decrease in the commercial price of this important chemical compound.

A further advantage of the present invention is the ready availability of the essential reactants. The essential reactants are elemental phosphorus, hydrogen halide (which is reusable), water, and electric current.

Various other advantages of this invention will become apparent from the accompanying description and claims.

SUMMARY OF THE INVENTION

Figure 1:
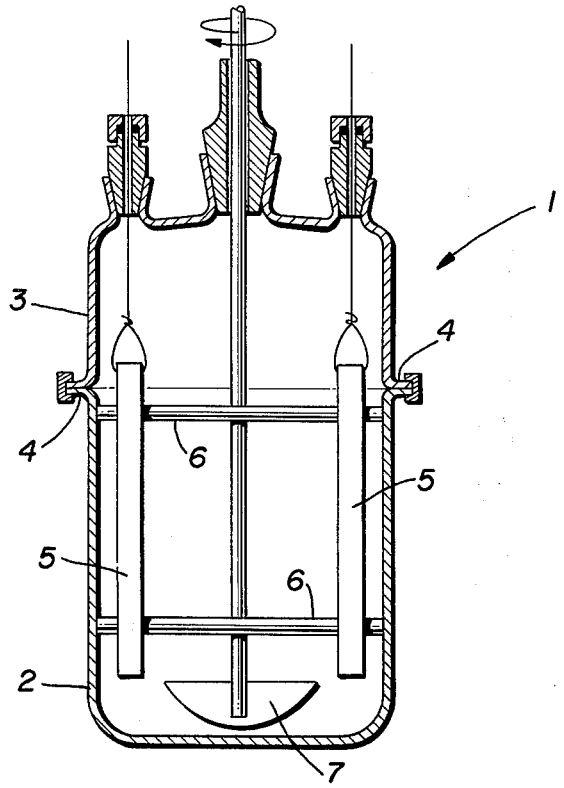
FIG. 1 is a schematic diagram of a cross section of an undivided electrolysis cell suitable for batch operation of the present invention.

According to the present invention, it has been discovered that phosphorous acid is conveniently prepared by the indirect electrolytic oxidation of elemental phosphorus.

DETAILED DESCRIPTION OF THE INVENTION

The indirect electrolytic oxidation of elemental phosphorous to phosphorous acid conveniently represented by reactions (2) through (5).

$$\text{ANODE REACTION } 3X^- \rightarrow 1\tfrac{1}{2} X_2 + 3e^- \quad (2)$$

$$\text{SOLUTION REACTIONS } 1\tfrac{1}{2} X_2 + \tfrac{1}{4}P_4 \rightarrow PX_3 \quad (3)$$

$$PX_3 + 3H_2O \rightarrow (HO)_2HPO + 3H^+ + 3X^- \quad (4)$$

$$\text{CATHODE REACTION } 3H^+ + 3e^- \rightarrow 1\tfrac{1}{2} H_2 \quad (5)$$

The net effect of reactions (2) through (5) of the present process are summarized as shown in reaction (6).

$$\tfrac{1}{4}P_4 + 3H_2O \rightarrow (HO)_2HPO + 1\tfrac{1}{2} H_2 \quad (6)$$

While not desiring to be bound by the theory of the present invention, it is believed that the process comprises:

a generation of molecular halogen from the corresponding halide ion by electrolytic oxidation at the anode of an aqueous solution of hydrogen halide;

b. oxidative reaction of the molecular halogen produced during the electrolysis with elemental phosphorus to form phosphorus trihalide, and c. hydrolysis of the thus-formed phosphorus trihalide to produce phosphorous acid and halide.

Electrolytic reduction of hydrogen ions (protons) at the cathode completes the electrochemical reaction.

Elemental phosphorus is a non-metallic element that exists in several allotropic forms (white or yellow, red, and black or violet). All of these forms can be used in the present invention but the white or yellow (the terms are used interchangeably) and red forms are preferred. Of these, the white or yellow form is particularly preferred. The term "elemental phosphorus," as used herein, designates these allotropic forms.

White phosphorus exists as $P_4$, having a tetrahedral molecular structure. It is a brittle, waxy solid which has a melting point of 44.1° C and a boiling point of 280.5° C. Its vapor density corresponds to a formula of $P_4$. It is virtually insoluble in water and alcohol, moderately soluble in chloroform, hexane, and benzene, and very soluble in carbon disulfide.

Because elemental phosphorous is insoluble in water, coupled with the fact that in the practice of the present invention the electrolysis medium comprises elemental phosphorus and an aqueous solution of hydrogen halide, the elemental phosphorus is conveniently suspended in the aqueous solution of hydrogen halide. And further, since white phosphorus, the preferred allotropic form, melts at 44.1° C, the electrolysis is conveniently carried out with the elemental phosphorus existing as a molten suspension.

Thus, it is preferred to agitate the electrolysis medium vigorously so as to insure a relatively uniform dispersion of the elemental phosphorus throughout the aqueous solution of hydrogen halide. Such agitation also facilitates the dispersal of impurities and thereby minimizes the tendency of such impurities gradually to coat the surface of the elemental phosphorus and prevent further reaction, particularly at process temperatures in excess of its melting point. Still further, such agitation insures thorough mixing the elemental phosphorus and the molecular halogen produced during the electrolysis. Moreover, the preferred vigorous agitation of the reaction mixture facilitates relatively rapid hydrolysis of the phosphorus trihalide to phosphorous acid. The agitation can be carried out in any conventional manner such as by flow mixers, jet mixers, injectors, turbulence mixers, circulatory mixer systems, centrifugal pumps, and the like; by paddle and propeller mixers of various designs as well as by turbine or centrifugal impeller mixers, colloid mills, and homogenizers.

The concentration of the aqueous solution of hydrogen halide can vary widely, for example, from about 0.5 percent to about 50 percent or more by weight of the aqueous phase, but preferred concentrations will often be in the range of about 1.0 percent to about 10 percent by weight, or on a molar basis, often in the range of about 0.1 molar to about 3.0 molar. It is to be noted, however, that the concentration of the aqueous solution of hydrogen halide has little effect on the current efficiencies and product distribution (although there might be a lower limit which would depend on the current density employed).

Various current densities can be employed in the present process. It will be desirable to employ high current densities in order to achieve high use of electrolysis cell capacity which will result in increased payload. Therefore, for production purposes it will generally be desirable to use as high a density as feasible, taking into consideration sources and cost of electrical current, resistance of the electrolysis medium, heat dissipation, effect upon yields, etc. Over broad ranges of current density, the density will not greatly affect the yield. And while low densities are operable, suitable ranges for efficient operation will generally be in the range of a few hundred amperes per square meter of anode surface, up to 10,000 to 20,000 or more amperes per square meter.

In effecting the present process, the cell voltage must be sufficient to pass the desired current (amperes) and to effect electrolytic oxidation for hydrogen halide. Generally this value should be as close to the theoretical cell voltage as possible, although it is recognized that the cell voltage will vary with electrode materials and their surface conditions, the distance between the electrodes, various materials in the electrolysis medium, resistance of the electrolysis medium, and resistance of cell dividers, when employed. For example, under the conditions employed in the procedural and illustrative Examples described hereinbelow the cell voltage is between about +6.0 volts and +8.0 volts.

The present process can be conducted in the various types of electrolysis cells known in the art. In general, such cells comprise a container made of material capable of resisting action of electrolytes, that is, material which is inert under the reaction conditions, for example, glass or plastic and a cathode and an anode, which are electrically connected to sources of electric current. The anode may be of any electrode material so long as it is relatively inert under the reaction conditions. Suitable anode materials include, for example, graphite, de Nora-type dimensionally stable anodes, the precious metals such as platinum, palladium, ruthenium, rhodium, and the like, and the precious metals plated onto other metals, such as, for example, titanium and tantalum, although the precious metal type anodes suffer from the disadvantage of being relatively expensive.

The de Nora-type dimensionally stable anodes employ precious metal oxides plated on a titanium substrate. Other materials include, for example, ruthenium oxide, mixed with oxides of titanium and tantalum, also plated on a titanium substrate. Dimensionally stable anodes suitable for use in the present process are currently commercially available from the Diamond Shamrock Company, Cleveland, Ohio.

The anode materials of choice, by analogy with the electrolysis of hydrochloric acid in chlorine cells which involves oxidation of chloride ion at the anode and reduction of hydrogen ions at the cathode, are graphite and de Nora-type dimensionally stable anodes. Graphite functions in the present invention satisfactorily except when an aqueous solution of hydrogen chloride is employed as the source of molecular halogen. In such instances the electrolysis causes significant anode corrosion to occur. It, therefore, becomes advantageous to employ the de Nora-type anodes which are sufficiently stable under the reaction conditions utilized so as to eliminate any corrosion problems. A further advantage resulting from the use of dimensionally stable anodes is the lowering of the halogen overvoltage with a concurrent lowering of energy requirements.

Any suitable electrode material may be employed as the cathode so long as it is relatively inert under the reaction conditions and does not promote the production of undesirable side products, such as, for example, phosphine in any significant amount. Graphite serves admirably as a satisfactory cathode material, even when aqueous hydrogen chloride is employed as the source of molecular halogen. If, therefore, is the material of choice. Low hydrogen overvoltage metals, such as, for example, platinum, palladium, and the like are also suitable as cathode material, although they suffer from the disadvantage of being relatively expensive. High hydrogen overvoltage metallic cathodes, such as, for example, mercury, zinc, lead, and the like may be used, but is advantageous and desirable to avoid their use in that they promote the direct reduction of phosphorus to phosphine.

While a divided cell may be employed in the practice of the present process, an undivided cell is generally preferred. Such a cell offers marked advantages over divided cells for commercial production purposes in that electrical resistance across a cell-divider is eliminated. It is to be noted, however, that when high hydrogen overvoltage metallic cathodes are employed divided cells may be preferred so as to avoid reduction of phosphorus to phosphine.

The electrolysis cell employed in the procedural Examples herein is primarily for laboratory demonstration purposes. Production cells are usually designed with a view to the economics of the process, and characteristically have large electrode surfaces and short distances between the electrodes.

The electrolysis cell utilized in the procedural and illustrative examples described hereinbelow is shown in FIG. 1 except for four other necks, one of which is used for addition of reactants and periodic sampling. It is stoppered during the electrolysis. The remaining three of the not-shown necks are used for gas-tight attachment of a water-cooled condenser topped with a mercury-sealed gas outlet and vent, a thermometer, and a gas-inlet tube.

Referring to FIG. 1, electrolysis cell 1 comprises a glass reaction vessel consisting of two sections--bottom section 2 and top section 3--joined together at flange joint 4 and secured by fastening means, such as, for example, metal fastening clamps.

Cell 1 is equipped with graphite electrodes (or de Nora-type dimensionally stable anode and graphite cathode) 5 which are spaced apart a suitable distance by Teflon rods 6. The Teflon rods 6 are extended to the sides of section 2 of cell 1 to maintain the electrode assembly rigid. Cell 1 is also equipped with a mechanical stirrer which is fitted with a large Teflon paddle 7 capable of effecting vigorous agitation of the reaction mixture.

For a general description of various laboratory scale cells see Lund et al, "Practical Problems in Electrolysis," in Organic Electrochemistry (Baizer, ed.), Marcel Dekker, New York, 1973, pp. 165–249, and for some consideration of industrial cells designs see Danly, "Industrial Electroorganic Chemistry," in Ibid., pp. 907–946.

The present process is suited to either batch or continuous operations. Continuous operations may involve, after product removal, recirculation of the aqueous electrolyte (aqueous solution of hydrogen halide) in a manner similar to that illustrated in FIG. 2.

Figure 2:
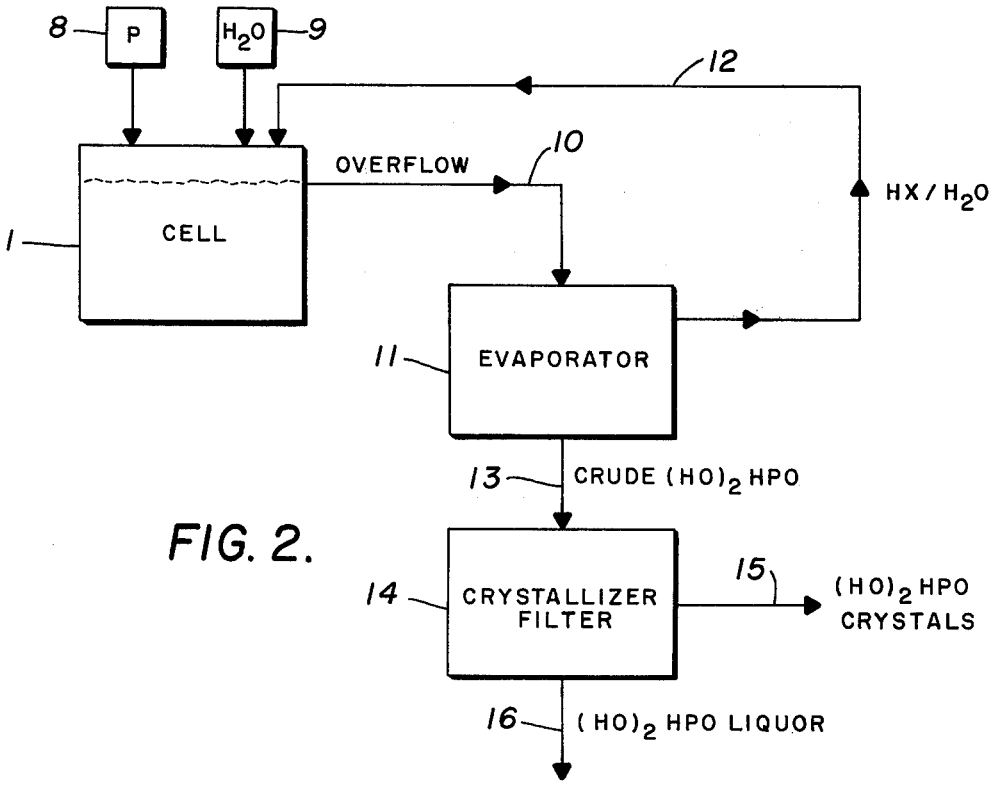
FIG. 2 is a schematic illustration of a typical flow diagram of a process suitable for continuous operation of the present invention.

In order to facilitate the explanation of one such continuous operation as contemplated herein, reference is made to FIG. 2. Electrolysis cell 1 is as shown in FIG. 1 except that it contains additional inlets and outlets sufficient to accommodate any desired additions, withdrawals, and recycling of materials. For example, elemental phosphorus is added from reservoir 8 and water is added from reservoir 9.

As the reaction of the present process proceeds, the aqueous solution containing dissolved phosphorous acid flows by overflow line 10 into evaporator 11 where the water and hydrogen halide (aqueous solution of hydrogen halide) are removed by evaporation. The aqueous solution of hydrogen halide is recycled to cell 1 by line 12 for repeated use as a source of molecular halogen. The crude phosphorous acid is discharged by line 13 to crystallizer-filter 14 where it is crystallized and filtered by suction filtration. The crystals are removed and collected through line 15 while the filtrate is discharged through line 16.

A number of options, including but not limited to those described hereinbelow, are available for utilizing the filtrate discharged through line 16. It can be (a) recycled to cell 1 to facilitate isolation of additional phosphorous acid on a repeated run through the reaction system; (b) transferred to a cell similar to cell 1, with an aqueous solution of hydrogen halide and exhaustively oxidized to phosphoric acid, which is useful as an article of commerce; (c) exhaustively oxidized to phosphoric acid by any other means known to the art, for example, catalytic oxidation; or (d) separated into its component acids by any suitable means known to the art, for example, counter current extraction as described in Kovacs et al, U.S. Pat. No. 3,769,384.

It is obvious that the counter current extraction process as described in Kovacs et al, U.S. Pat. No. 3,769,384 can also be applied to the aqueous solution flowing through overflow line 10 as well as the crude phosphorous acid discharged by line 15.

The electrolysis of the present process can be conducted at a broad range of temperatures—ambient, or higher or lower temperatures—without any significant effect upon the course of the reaction and the yield of the desired phosphorous acid. For example, temperature ranges from about 20° C or lower to about 180° C are satisfactory. If desired, cooling can be effected by permitting a component, for example, water reflux through a cooling condenser, or by immersing the electrolysis cell in an ice or ice-salt bath. The amount of cooling capacity needed for the desired degree of control will obviously depend upon the cell resistance and the electrical current drawn.

Pressure can be employed to permit electrolysis at higher temperatures, but unnecessary employment of pressure is usually undesirable from an economic standpoint. Moreover, it is to be noted that phosphorous acid, on being subjected to excessive heat, undergoes disproportionation to phosphoric acid and phosphine and/or hydrogen as illustrated in reactions (7) and (8).

$$4(HO)_2HPO \xrightarrow{heat} 3(HO)_3PO + PH_3 \quad (7)$$

$$(HO)_2HPO + H_2O \xrightarrow{heat} (HO)_3PO + H_2 \quad (8)$$

Therefore, the preferred temperature is any temperature not sufficient to cause substantial disproportionation. More particularly, the preferred temperature is less than 180° C and greater than the melting point of the elemental phosphorous utilized because at temperatures greater than 180° C reactions (7) and (8) occur at a fairly rapid rate and at temperatures greater than the melting point of the elemental phosphorous utilized, the elemental phosphorous will exist in molten form which facilitates its dispersal throughout the aqueous solution of hydrogen halide.

The process of the present invention involves an indirect electrolytic oxidation and therefore requires a source of oxidizing agent. Aqueous hydrogen halide which is employed in catalytic amounts admirably serves this purpose. The preferred molar ratio range of elemental phosphorous to hydrogen halide present in the aqueous solution is between about 1:1 and about 20:1, although the molar ratio can be considerably higher or lower as desired.

While it is recognized that any means known to the art, such as, for example, employing (a) a greater or lesser volume of the aqueous solution of hydrogen halide having the same concentration; (b) a greater or lesser molar quantity of elemental phosphorus; or (c) some combination of (a) and (b) can be employed to effect a change in the molar ratio of elemental phosphorus to hydrogen halide, a convenient means of effecting such a change is simply to increase or decrease the concentration of the aqueous solution of hydrogen halide. And as noted hereinbefore, the concentration of hydrogen halide has little effect on the current efficiencies and product distribution.

The hydrogen halides preferred for use in the present process are hydrogen chloride, hydrogen bromide, and hydrogen iodide. Of these, hydrogen bromide and hydrogen iodide are particularly preferred because of (a) the stability of graphite anodes in their aqueous solutions under process conditions; and (b) the high selectivity towards phosphorous acid which is observed when they are employed. It is recognized, however, that in view of its lower cost, hydrogen chloride might be the hydrogen halide of choice.

The term "selectivity" is employed herein to mean the percentage of reacting molecules of elemental phosphorus converted to phosphorus acid.

Without limiting the present invention in any way, it is believed that in accordance therewith, the hydrogen halide is electrolytically oxidized to molecular halogen, which in turn oxidatively reacts with elemental phosphorus to form phosphorus trihalide. The thus-formed phosphorus trihalide is hydrolyzed to the desired phosphorous acid and hydrogen halide. In this case, however, the need for external means for disposing of the hydrogen halide generated thereby is eliminated; it is disposed of in situ by recycling by means of electrolytic oxidation to molecular halogen for reuse as a reactant. That is, the halide ions are electrolytically oxidized to regenerate molecular halogen which further reacts with elemental phosphorous to produce additional phosphorous trihalide. At the same time the hydrogen ions are electrolytically reduced at the cathode to generate hydrogen gas which, being non-polluting, is safely vented into the atmosphere, or, alternatively, flared to produce gaseous water as the only product.

This means of disposing of the hydrogen halide generated during the hydrolysis of phosphorus trihalide to phosphorous acid provides obvious advantages over procedures described in the prior art.

The phosphorous acid produced in the present invention is conveniently recovered in the form of the free acid. However, it is to be understood that the isolation procedures employed in the procedural Examples and discussed herein are primarily for illustrative purposes. Other procedures can be employed, and may be preferred, for commercial purposes.

Upon completion of the reaction, the aqueous solution is filtered, if necessary, to remove unreacted elemental phosphorous and, if desired, analyzed to determine the total yield of phosphorous acid. Utilizing this value and the total amount of elemental phosphorous consumed during the reaction, the percentage yield of phosphorous acid can also be determined. And while any method of phosphorous acid analysis known to the art can be employed, a method suitable for use herein is hydrogen-1 and phosphorous-31 nuclear magnetic resonance spectroscopy which provides a convenient and efficient method of analysis.

The aqueous filtrate is evaporated in vacuo at moderate temperatures to yield a viscous liquid which upon cooling to ambient temperatures partially crystallizes. More complete and more rapid crystallization can be induced by using subambient temperatures and by the addition of a seed crystal of phosphorous acid to the viscous liquid. Filtration of the crystallized mass with prolonged suction under a nitrogen atmosphere yields phosphorous acid as white crystals.

The filtrate from the isolation of phosphorous acid can be recycled to electrolysis cell 1 to facilitate isolation of additional phosphorous acid upon repeating the present process. It can also be utilized by employing any of the remaining available options as described hereinabove.

The following examples illustrate the present invention and the manner by which it can be practiced.

EXAMPLE 1

The reaction was carried out in an undivided cell (FIG. 1) comprising a 1-liter glass reaction vessel consisting of two sections—a bottom section and a top section—joined together at the flange joint and secured by fastening means, such as, for example, metal fastening clamps. The top section had seven necks, with standard-taper inner joints, used for gas-tight attachment of a mechanical stirrer, two platinum wire electrode connections, a thermometer, a water-cooled condenser topped with a mercury sealed gas outlet and vent, and a gas-inlet tube. The remaining neck was used for addition of reactants and was stopped during the electrolysis. The bottom section had a usable volume up to the flange joint of about 800 milliliters. The cell was equipped with graphite-plate electrodes measuring 10 × 6 × 1.2 centimeters and spaced 3 centimeters apart by Teflon rods which were extended to the sides of the glass reaction vessel to maintain the electrode assembly rigid. Vigorous agitation of the reaction mixture was accomplished by a mechanical stirrer fitted with a large Teflon paddle.

A mixture of white phosphorous (100.0 grams, 3.23 moles) and aqueous hydrogen bromide (400 milliliters, 2.4 percent, 0.176 mole; prepared from 20 milliliters of 48 percent aqueous hydrogen bromide and 380 milliliters of water) was placed in the electrolysis cell and heated to about 50° C under a nitrogen atmosphere. The mixture was vigorously agitated to disperse the now molten phosphorus and electrolyzed with a constant current of 10 amperes for 26 hours (which is equivalent to 260 ampere-hours which equal 9.7 Faradays which equal 3.0 Faradays per mole of white phosphorus). Throughout the electrolysis, vigorous agitation and nitrogen purging were maintained. The initial cell voltage of about +8.0 volts gradually decreased over the electrolysis period to about +6.0 volts. The passage of current maintained the reaction mixture at a temperature of between about 70° C and about 80° C throughout the electrolysis. Upon completion of the reaction, the cell and its contents were allowed to cool to ambient temperatures, whereupon the reaction mixture was filtered in a nitrogen atmosphere to remove unreacted white phosphorus. The filtrate was analyzed by hydrogen-1 and phosphorus-31 nuclear magnetic resonance spectroscopy and found to contain phosphorous acid (1.02 moles), hypophosphoric acid (0.08 mole) and phosphoric acid (0.79 mole). Evaporation of the filtrate in vacuo at moderate temperatures of between about 70° C and about 80° C gave a viscous liquid which was seeded with a crystal of phosphorous acid. The crystallized mass was filtered with prolonged suction under a nitrogen atmosphere to give phosphorous acid (39.0 grams) containing about 5 mole percent phosphoric acid and having an overall purity of about 92 percent which corresponds to a yield of 0.44 mole.

The current efficiency for the combined production of phosphorus acids (phosphorous acid, hypophosphoric acid, and phosphoric acid) was 61 percent, the apparent conversion of white phosphorus to phosphorus acids as determined by hydrogen-1 and phosphorus-31 nuclear magnetic resonance spectroscopic analysis was also 61 percent; the percentage yield of phosphorous acid isolated was 22 percent based on the apparent conversion of white phosphorus; and the selectivity to phosphorous acid was 52 percent.

EXAMPLE 2

Following the procedure of EXAMPLE 1 above, a mixture of white phosphorus (40.0 grams, 1.3 moles) and aqueous hydrogen iodide (400 milliliters, 5.7 percent, 0.3 mole; prepared from 40 milliliters of 57 percent aqueous hydrogen iodide and 360 milliliters of water) was electrolyzed with a constant current of 10 amperes for 10 hours (which is equivalent to 100 ampere-hours which equal 3.7 Faradays which equal 2.8 Faradays per mole of white phosphorus). The initial cell voltage of about +7.0 volts gradually decreased over the electrolysis period to about +6.0 volts. Hydrogen-1 and phosphorus-31 nuclear magnetic resonance spectroscopic analysis of the aqueous filtrate following removal of unreacted white phosphorus showed the presence of phosphorous acid (0.36 mole), hypophosphoric acid (0.03 mole), and phosphoric acid (0.15 mole).

The current efficiency for the combined production of phosphorus acids was 55 percent; the apparent conversion of white phosphorus to phosphorus acids was 44 percent; and the selectivity to phosphorous acid was 63 percent.

Phosphorous acid has a number of useful purposes. It is useful as a reducing agent where a strong but relatively slow-acting reducing agent is desirable. It is also useful as a starting material for the production of phosphitic esters such as diethyl phosphite, which is useful as a lubricant additive, antioxidant, and solvent.

Phosphorous acid is also employed as a starting material in the preparation of valuable phosphonate compounds such as ethane-1-hydroxy-1,1-diphosphonic acid which, including water soluble derivatives thereof, are valuable builders for detergent compositions as described in Diehl, U.S. Pat. No. 3,159,581. In addition, phosphorous acid is useful in the preparation of various phosphonomethylamines. Such compounds are known agents for various water treating and similar purposes, particularly as scale inhibiting agents as described in Ralson, U.S. Pat. No. 3,336,221, and as metal ion sequestering agents as described in Irani, U.S. Pat. No. 3,234,124. In addition to scale inhibition in boiler waters, and the like, such agents are effective in inhibiting corrosion of iron, steel, and other metals coming into contact with such water under highly oxygenated or otherwise possibly corrosive conditions. And, because of their inhibiting, anti-precipitant, chelating, and sequestering properties, such agents are usefully employed in various soaps, detergents, and cleaning compounds.

While the invention has been described with respect to various specific examples and embodiments thereof, it is to be understood that the invention is not limited thereto and that many alternatives, modifications, and variations will be apparent to those skilled in the art in light of the foregoing description. Accordingly, it is intended to embrace all such alternatives, modifications, and variations as fall within the spirit and broad scope of the invention.

What is claimed is:

1. A process for the indirect electrolytic oxidation of elemental phosphorus to phosphorous acid which comprises subjecting an electrolysis medium comprising elemental phosphorus and an aqueous solution of hydrogen halide to electrolysis, and thereafter recovering phosphorous acid.

2. The process of claim 1 wherein a. molecular halogen is generated from the corresponding halide ion by electrolytic oxidation at the anode of an aqueous solution of hydrogen halide;

b. said molecular halogen produced during the electrolysis oxidatively reacts with the elemental phosphorus to form phosphorus trihalide;

c. said phosphorus trihalide is hydrolyzed to produce phosphorous acid and hydrogen halide;

d. said hydrogen halide is recycled; and e. said phosphorous acid is recovered.

3. The process of claim 2 wherein the phosphorus trihalide is phosphorus trichloride.

4. The process of claim 2 wherein the phosphorus trihalide is phosphorus tribromide.

5. The process of claim 2 wherein the phosphorus trihalide is phosphorus triiodide.

6. The process of claim 2 wherein the hydrogen halide generated during the hydrolysis of phosphorus trihalide to phosphorus acid is disposed in situ by recycling by means of electrolytic oxidation to molecular halogen for reuse as a reactant.

7. The process of claim 1 wherein the cell voltage is sufficient to pass the desired current and to effect electrolytic oxidation of hydrogen halide.

8. The process of claim 7 wherein the cell voltage is between about +6.0 volts and about +8.0 volts.

9. The process of claim 1 wherein the elemental phosphorus is white phosphorus.

10. The process of claim 1 wherein the molar ratio of elemental phosphorous to hydrogen halide present in the aqueous solution is between about 1:1 and about 20:1 and the process temperature is between about 45° and about 150° C.

11. The process of claim 1 wherein a graphite anode and a graphite cathode are used.

12. The process of claim 1 wherein a de Nora-type dimensionally stable anode and a graphite cathode are used.

* * * * *